US009129525B2

(12) United States Patent
Frish et al.

(10) Patent No.: US 9,129,525 B2
(45) Date of Patent: Sep. 8, 2015

(54) TRAFFIC LIGHT CONTROL USING DESTINATION INFORMATION IN CALENDAR DATA OF A USER DEVICE

(71) Applicant: MOTOROLA SOLUTIONS, INC, Schaumburg (IL)

(72) Inventors: Amiram Frish, Kibutz Nahshon (IL); Salomon Serfaty, Gaash (IL)

(73) Assignee: MOTOROLA SOLUTIONS, INC., Schaumburg, IL (US)

( * ) Notice: Subject to any disclaimer, the term of this patent is extended or adjusted under 35 U.S.C. 154(b) by 108 days.

(21) Appl. No.: 13/955,046

(22) Filed: Jul. 31, 2013

(65) Prior Publication Data

US 2015/0035686 A1 Feb. 5, 2015

(51) Int. Cl.
*G08G 1/095* (2006.01)
*G08G 1/07* (2006.01)

(52) U.S. Cl.
CPC . *G08G 1/07* (2013.01); *G08G 1/095* (2013.01)

(58) Field of Classification Search
CPC . G08G 1/0112; G08G 1/0137; G08G 1/0145; G08G 1/07; G08G 1/08; G08G 1/081; G08G 1/095; G08G 1/087; G08G 1/096716; G08G 1/096783; G08G 1/096758; G08G 1/096775; G08G 1/0965; G01S 19/41
USPC ..... 340/907, 906, 917, 931; 701/117, 119
See application file for complete search history.

(56) References Cited

U.S. PATENT DOCUMENTS

| | | | | |
|---|---|---|---|---|
| 8,040,254 | B2 * | 10/2011 | Delia et al. | 340/907 |
| 8,406,770 | B2 | 3/2013 | Smith | |
| 8,456,325 | B1 | 6/2013 | Sikora | |
| 8,855,900 | B2 * | 10/2014 | Lection et al. | 701/117 |
| 2003/0014181 | A1 | 1/2003 | Myr | |
| 2003/0069683 | A1 | 4/2003 | Laidot et al. | |
| 2003/0128135 | A1 * | 7/2003 | Poltorak | 340/906 |
| 2011/0037619 | A1 * | 2/2011 | Ginsberg et al. | 340/910 |
| 2012/0129517 | A1 | 5/2012 | Fox et al. | |
| 2012/0139755 | A1 | 6/2012 | Ginsberg | |

* cited by examiner

*Primary Examiner* — Anh V La
(74) *Attorney, Agent, or Firm* — Brian Mancini; Daniel R. Bestor

(57) ABSTRACT

Traffic light control using destination information in calendar data of a user device includes storing calendar data including destination information in a plurality of user devices in a community. A next step includes obtaining the calendar data by a community authority coordinator operable to communicate with the user devices through a community network. A next step includes controlling at least one traffic light in the community in response to the destination information. Optionally, the traffic light can be controlled in response to time, date, location, route, and number of vehicles, to alleviate future road congestion.

18 Claims, 2 Drawing Sheets

TRAFFIC LIGHT CONTROL USING DESTINATION INFORMATION IN CALENDAR DATA OF A USER DEVICE

BACKGROUND

Several systems have been introduced recently that use externally collected information to control traffic lights. Existing traffic light control systems use a variety of road and junction detectors and sensors ranging from stop bar detectors, camera and video car detectors, and even radar systems to predict the incoming traffic flow into a traffic light controlled junction. However, the cost of deployment and maintenance of such systems is extremely high due to the amount of detectors needed and is the main reason why fixed cycle traffic lights are still widely used.

In another example, the location of vehicles that are being tracked by a network using Global Positioning System information can be used for traffic light control. In recent years, smart phones have emerged having community networks applications such as Waze™, Google Maps™, and iGo™ that provide new opportunities for GPS assisted traffic control. These applications are designed for the mobile community, which by sharing known location, speed, destination, hazards, traffic jams, inappropriate drive behavior, and the like, allows those applications to build up-to-date road maps, find optimal routes to desired destination, estimate time of arrival, communicate road hazards, and many more useful services using advanced algorithms. However, these applications do not account for future driver behaviors and traffic conditions, where reliable prediction would be a key factor in intelligent traffic light control.

Accordingly, there is a need for an improved technique to reliably predict future driver behaviors and traffic conditions, using community networks knowledge, for intelligent traffic light control.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
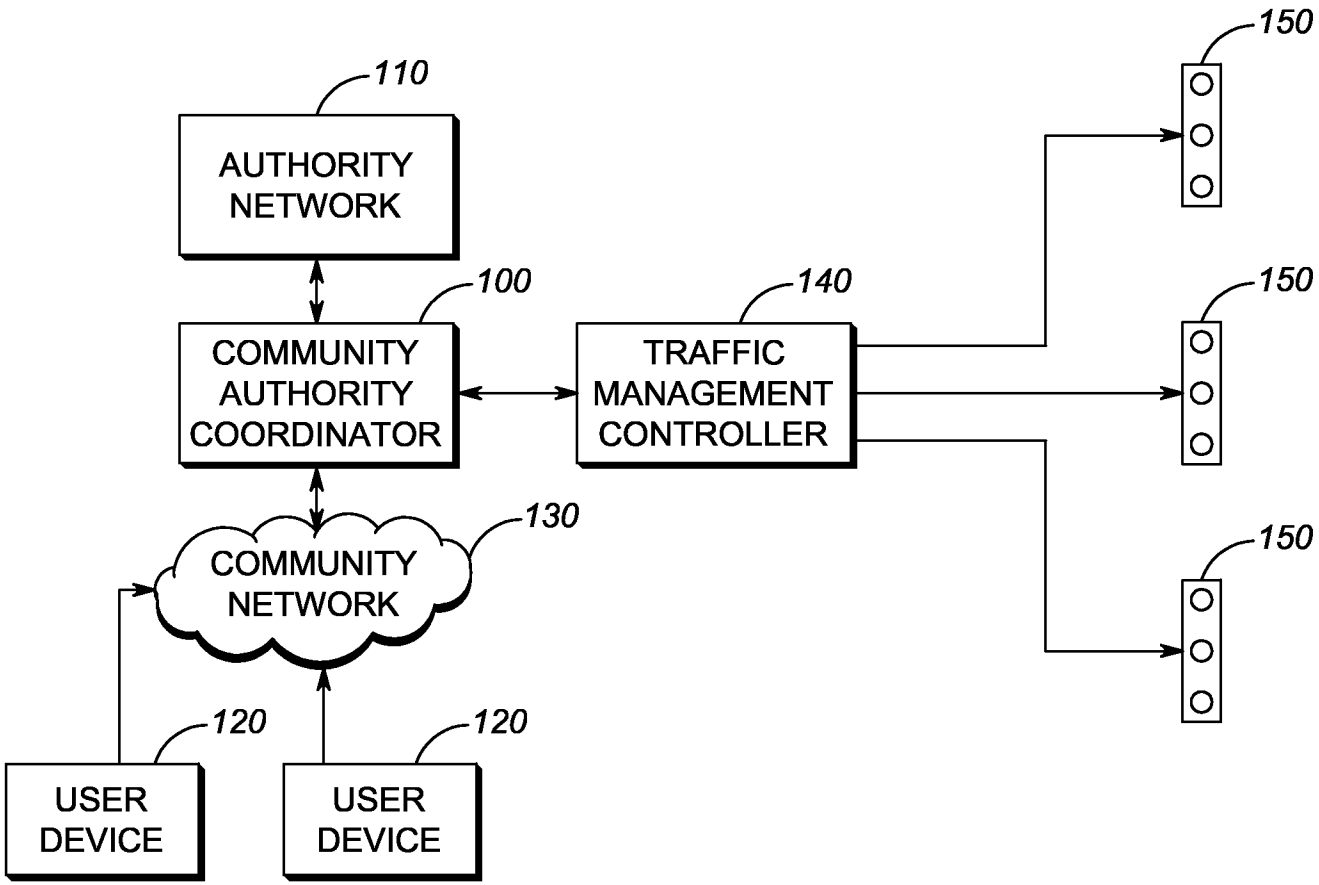
FIG. 1 is a block diagram of a system, in accordance with some embodiments of the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

According to some embodiments of the present invention, an improved technique is described to reliably predict future driver behaviors and traffic conditions, using community network knowledge, for intelligent traffic light control. In particular, the present invention looks at a calendar application in a plurality of user devices and obtains future destination and optionally, time, date, or other information therefrom. The present invention then uses this information to control traffic lights at that future destination, time, and date. For example, if many vehicles were arriving at a concert in one hour, the traffic lights could be controlled accordingly to accommodate this future traffic.

The device providing the calendar data, time, and destination information can include a wide variety of business and consumer electronic platforms such as cellular radio telephones, mobile stations, mobile units, mobile nodes, user equipment, subscriber equipment, subscriber stations, mobile computers, access terminals, remote terminals, terminal equipment, cordless handsets, gaming devices, personal computers, and personal digital assistants, and the like, all referred to herein as a device. Each device comprises a processor that can be further coupled to a keypad, a speaker, a microphone, a display, signal processors, and other features, as are known in the art and therefore not shown.

Various entities are adapted to support the inventive concepts of the embodiments of the present invention. Those skilled in the art will recognize that the drawings herein do not depict all of the equipment necessary for system to operate but only those system components and logical entities particularly relevant to the description of embodiments herein. For example, routers, controllers, and wireless client devices can all includes separate communication interfaces, transceivers, memories, and the like, all under control of a processor. In general, components such as processors, transceivers, memories, and interfaces are well-known. For example, processing units are known to comprise basic components such as, but not limited to, microprocessors, microcontrollers, memory cache, application-specific integrated circuits, and/or logic circuitry. Such components are typically adapted to implement algorithms and/or protocols that have been expressed using high-level design languages or descriptions, expressed using computer instructions, expressed using messaging logic flow diagrams.

Thus, given an algorithm, a logic flow, a messaging/signaling flow, and/or a protocol specification, those skilled in the art are aware of the many design and development techniques available to implement one or more processors that perform the given logic. Therefore, the entities shown represent a system that has been adapted, in accordance with the description herein, to implement various embodiments of the present invention. Furthermore, those skilled in the art will recognize that aspects of the present invention may be implemented in and across various physical components and none are necessarily limited to single platform implementations. For example, the memory and control aspects of the present invention may be implemented in any of the devices listed above or distributed across such components.

FIG. 1 is a block diagram of a system for traffic light control in a community using destination information in calendar data of a plurality of user devices, in accordance with the present invention. The system comprises users and user devices 120, which can include cellular communication device or smart phones and including vehicular communication devices, as long as those devices include calendar data. The system can also include Community Networks Applications (CNA), a Community Authority Coordination (CAC) 100, a Traffic Management Controller (TMC) 140, traffic lights 150, traffic light phase control and TMC to traffic lights phase control communication system.

The CAC is a novel component, the purpose of which is to coordinate data exchange between an authority network 110 and the community network 130 such that it satisfies the needs and requirements of the CNA and an authority controlling the traffic lights 150. The community network 130 supports geographical communities such as villages or towns and can include social networks and is operable using a 3G or 4G Wi-Fi™ communication network or equivalent wired or wireless network, as is known in the art. The CAC 100 is also operable to exchange data with the user devices 120 over the community network 130.

The component functionalities can vary between authorities and CNAs, but will typically provide: CNA failure detections and notifications, traffic light states feedback, CNA user specific data masking (maintaining user anonymity), traffic light control algorithm based on CNA data and failsafe traffic control (that reverts the traffic lights to a preset fixed cycle time when recognizing a failure in the system such as communications, hacking attempts, power outages, etc.)

The community includes a plurality of user devices operable to store calendar data including destination information, and can include date and time information for a calendar event. The CAC is operable to communicate with the user devices through the community or a social network to obtain the calendar data, which can include the date, time, and destination information for a calendar event. It should be noted that the user device need not be in a vehicle at the time. Just knowing the a user (at home) will be traveling to an event destination at a later time, probably using personal transportation, is sufficient for the present invention to trigger the future traffic light control.

However, for the case where a user device is associated with a vehicle, such a user device can also share known location, speed, hazards, and the like, in order to provide further traffic knowledge which the system can use to minimize significantly road congestion and traffic jams—and most notably predict/prevent future congestion and control traffic lights accordingly to provide users with the means to reach their destination faster and safer. More specifically, such traffic knowledge can provide more accurate predictions for the future state of traffic, a key point for traffic light control. Further authority knowledge sharing of road blocks, accident, hazards, vehicle whereabouts and events may also help the system to regulate traffic for the benefit of all.

In practice, the operation of an existing community TMC 140 is modified by the CAC to control traffic lights in response to the destination (date and time) information obtained by the CAC from the plurality of user devices. For example, if there are many user devices that have a calendar event stored for a concert in the city, the CAC can direct the TMC to allow longer green lights for routes entering the concert venue destination parking lot for one-hour before the event is scheduled to begin from the calendar data, and allow longer green lights for routes leaving the concert venue parking lot for one-hour after the event is scheduled to end from the calendar data. Further, if the CAC can use the number of user devices indicating the same date, time, and destination information for controlling the length of the traffic lights. For example, if one thousand people are attending an event, the length of green lights at or near the event destination need not be as long as if ten thousand people are attending that event.

As is known, smart phones are also able to provide their current location to requesting applications, using a GPS system for example. If the CAC can obtain this current location information also, then traffic light control can be expanded to not only control traffic lights at the destination but also those traffic lights along a common route that may be shared by many user vehicles going to the same destination, given the known current or starting locations, and possibly pre-planned route, of the user devices or vehicles. In the small scale of a junction, this route information can define what junction exit will the vehicle will take, and on a larger scale the entire route could be mapped. In either case, this routing data provides more meaningful information to the traffic light control algorithm, thereby improving its performance.

The present invention could simply process raw data for traffic light control or could use processed data, including arrival flow measures, destination flow measures, arrival times, hazards, etc. Also, the TMC is operable to revert to a failsafe operating mode when abnormal conditions are detected in order to guaranty failsafe traffic light control. For example, if unreasonable statistics/behavior or a hacking attempt is detected on the system, the TMC can revert to a fixed cycle of traffic light operation or implement a maximum phase lock time where the traffic light junction will have maximum time to remain on each phase. Along these lines, the present invention can be managed by an authority network 110, wherein the CAC compares a request for traffic light control from a requesting device against a list of authorized requesting devices from the authority network before allowing the request. Similarly, the traffic lights can also be controlled in response to authority vehicles (police, fire, ambulance, etc.) or authority events (accident, junction malfunction, road block. etc.). In particular, the system can regulate traffic light behavior in the surrounding areas to avoid congestion in the path according to authority events or movement of authority vehicles.

As far as privacy concerns, the CAC can guaranty user anonymity by masking user specific data such as, ID, car number, address or by using only CNA processed data such as estimated amount of arriving vehicles, amount of vehicles per junction output destination, incoming/outgoing junction traffic flow measures.

Figure 2:
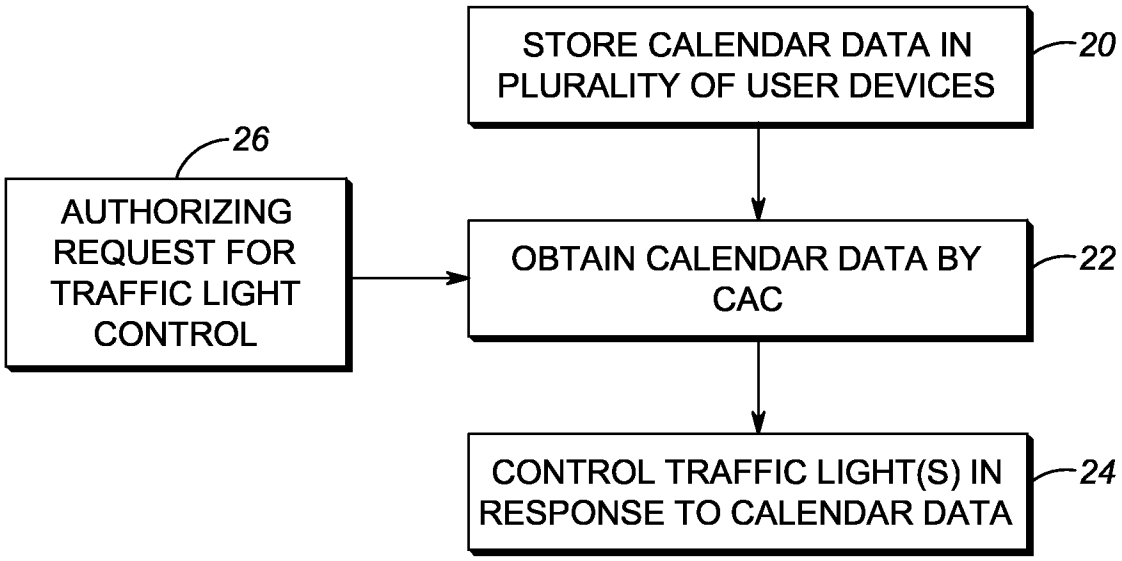
FIG. 2 is a diagram illustrating a method, in accordance with some embodiments of the present invention.

FIG. 2 is a diagram illustrating a method for traffic light control using destination information in calendar data of a user device, according to some embodiments of the present invention.

A first step 20 includes storing calendar data including destination information in a plurality of user devices in a community. The user devices can include user's mobile phones, computers, and vehicles. The calendar data can also include date and time information for a calendar event.

A next step 22 includes obtaining the calendar data by a community authority coordinator operable to communicate with the user devices through a community network.

A next step 24 includes controlling at least one traffic light in the community in response to the destination information, and optionally information including date, time, number of user devices, authority vehicles (e.g. police, fire, ambulance) near the destination, and other information. The at least one traffic light can be one near the destination or those along a route to the destination, given a route from known locations of user vehicles to the destination. If abnormal conditions are detected, this step includes reverting operation of the traffic lights to a failsafe operating mode.

An optional step 26 includes authorizing a request from a requesting device for traffic light control by the community authority coordinator.

Advantageously, the present invention provides two-way traffic knowledge sharing between community networks and the authority network, which results in a more complete picture of real time traffic as well as estimated future traffic states. No road and junction sensors or detectors are required. This enables extremely high quality control of traffic to be achieved. The present invention can be used to control a single junction, street, village, city, district or country resulting in a highly scalable solution with little to no extra effort and cost for increased scale. The present invention can also integrate with the existing traffic light control network and communication network.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A system for traffic light control using destination information in calendar data of a user device, the system comprising:

a plurality of user devices from multiple users, operable to store calendar data, wherein the calendar data stored on each of the plurality of user devices comprises a future destination, a date, and a time;

a community authority coordinator (CAC) operable to communicate with the user devices through a community network and obtain the calendar data; and a traffic management controller coupled to the CAC and operable to receive instructions from the CAC to control at least one traffic light in a community in response to the future destinations, dates, and times stored on the plurality of user devices.

2. The system of claim 1, wherein at least one user device is a smart phone.

3. The system of claim 1, wherein the calendar data includes date and time information for when a user is to reach the destination indicated in the calendar, and wherein the at least one traffic light is also controlled in response to the date and time information.

4. The system of claim 3, wherein the at least one traffic light is also controlled in response to the number of user devices indicating the same date, time, and destination information.

5. The system of claim 1, wherein the at least one traffic light to be controlled is near the destination.

6. The system of claim 1, wherein the at least one traffic light to be controlled is along a route from known locations of user vehicles to the destination.

7. The system of claim 1, further comprising an authority network, wherein the CAC compares a request for traffic light control from a requesting device against a list of authorized requesting devices from the authority network before allowing the request.

8. The system of claim 1, wherein the at least one traffic light is also controlled in response to authority vehicles.

9. The system of claim 1, wherein the traffic management controller is operable to revert to a failsafe operating mode when abnormal conditions are detected.

10. A method for traffic light control using destination information in calendar data of a user device, the method comprising:

obtaining calendar data from multiple users by a community authority coordinator (CAC), wherein the calendar data is stored on a plurality of user devices, and wherein the CAC is operable to communicate with the user devices through a community network, and wherein the calendar data obtained from each of the plurality of user devices comprises a future destination, a date, and a time; and controlling at least one traffic light in the community in response to the future destinations, dates, and times stored on the plurality of user devices.

11. The method of claim 10, wherein at least one user device is a smart phone.

12. The method of claim 10, wherein storing the calendar data includes date and time information for when a user is to reach the destination indicated in the calendar, and wherein controlling includes also controlling the at least one traffic light in response to the date and time information.

13. The method of claim 12, wherein controlling includes also controlling the at least one traffic light in response to the number of user devices indicating the same date, time, and destination information.

14. The method of claim 10, wherein the at least one traffic light in the controlling step is near the destination.

15. The method of claim 10, wherein the at least one traffic light in the controlling step is along a route from known locations of user vehicles to the destination.

16. The method of claim 10, further comprising authorizing a request for traffic light control from a requesting device.

17. The method of claim 10, wherein controlling includes also controlling the at least one traffic light in response to authority vehicles.

18. The method of claim 10, wherein controlling includes reverting to a failsafe operating mode when abnormal conditions are detected.

* * * * *